US006324704B1

(12) United States Patent
Imo

(10) Patent No.: US 6,324,704 B1
(45) Date of Patent: Dec. 4, 2001

(54) FLEXIBLE CONTAINER FOR RETAINING FLUID WASTE

(76) Inventor: Francesco C. Imo, 5828 Cataumet, St. Louis, MO (US) 63102

( * ) Notice: Subject to any disclaimer, the term of this patent is extended or adjusted under 35 U.S.C. 154(b) by 0 days.

(21) Appl. No.: 09/578,009

(22) Filed: May 24, 2000

(51) Int. Cl.[7] ..... A47K 11/12
(52) U.S. Cl. ..... 4/144.2; 4/144.3; 604/349
(58) Field of Search ..... 4/144.2, 144.3, 4/451, 454, 460; 604/349, 347, 544

(56) References Cited

U.S. PATENT DOCUMENTS

| | | | | |
|---|---|---|---|---|
| D. 366,142 | | 1/1996 | Becker . | |
| 3,164,186 | | 1/1965 | Weber et al. . | |
| 3,297,152 | | 1/1967 | Corella et al. . | |
| 3,331,421 | | 7/1967 | Lambert . | |
| 3,346,883 | | 10/1967 | Ersek . | |
| 3,403,410 | | 10/1968 | Benzel et al. . | |
| 3,403,715 | | 10/1968 | Trudel . | |
| 3,597,770 | | 8/1971 | Jacuzzi et al. . | |
| 5,007,116 | * | 4/1991 | Yamamoto | 4/144.2 |
| 5,065,459 | * | 11/1991 | Tjahaja et al. | 4/144.2 |
| 5,263,446 | * | 11/1993 | Klug | 604/349 X |
| 5,309,578 | | 5/1994 | Temple, Sr. . | |
| 5,354,132 | | 10/1994 | Young et al. . | |
| 5,569,225 | * | 10/1996 | Fleury | 604/349 X |
| 5,745,926 | | 5/1998 | Cailleteau . | |
| 5,894,607 | | 4/1999 | Van den Burg . | |
| 6,116,780 | * | 9/2000 | Young et al. | 4/144.2 X |

* cited by examiner

*Primary Examiner*—Timothy L. Maust
*Assistant Examiner*—Kathleen J. Prunner
(74) *Attorney, Agent, or Firm*—Greensfelder, Hemker & Gale, P.C.

(57) ABSTRACT

A container for receiving and retaining human fluid waste is provided. The container is comprised of a flexible bag having a containment chamber and a passage chamber, with resealable sealing elements for closing off each chamber. The bag has handle members disposed on the outside of the bag at the location of the passage chamber. A gap is provided between the handle member and the bag for receiving a user's fingers for a secure grasp.

10 Claims, 5 Drawing Sheets

FLEXIBLE CONTAINER FOR RETAINING FLUID WASTE

BACKGROUND OF THE INVENTION

This invention relates to flexible containers and bags for receiving and retaining human waste fluid such as urine. There exist many situations in which a person needs to eliminate urine, yet does not have access to appropriate toilet facilities. Hunters are especially familiar with this situation, as they typically spend many hours out in the woods, oftentimes in the same spot. While relieving oneself on the ground in the great outdoors presents a tempting solution, it is unwise to do so. Besides being unsanitary, the deposited urine leaves a lingering, distinct scent which may alert prey to the hunter's presence. Therefore, the hunter must either leave his blind or stand in search of a remote area to urinate to avoid compromising his hunting spot, or, instead, must sit still and bear the discomfort.

Another option is for the hunter to urinate into a container which can safely retain the fluid waste for later disposal. There exist many devices that provide such a container, ranging from flasks or jugs to flexible plastic bags. For any such type of device, however, it is important that it be made convenient to carry and simple to use. Hunters do not like to carry a lot of excess items out to the field, therefore rigid containers are not usually favored. Weather conditions may be cold and a hunter's hands may be chilled and cramped, therefore the device should be easily opened and closed to minimize spillage or leakage. The device should also be easy to hold and manipulate so that the hunter does not drop the device during usage.

SUMMARY OF THE INVENTION

By means of the instant invention there is provided a container for receiving and retaining human fluid waste, such as urine.. The container is comprised of an elongated flexible bag having a containment chamber and a passage chamber. The containment chamber is designed to receive and hold the deposited urine and has a sealing element at a top thereof. The passage chamber is positioned above and connected to the containment chamber. It is designed to act as a sheath to receive the male's penis to ensure that deposited urine is directed down to the containment chamber. A second sealing element is placed at the top of the passage chamber. Thus there exist two sealing elements to seal off the container to prevent spillage or leakage of stored urine. The sealing elements are adapted to be opened and closed, so that the container can be used repeatedly. Handles are provided at the sides of the passage chamber so that the user can securely grasp the container. The handles are formed as gaps at the edges of the bag to allow the user's fingers to pass through for an enhanced grip. Another embodiment of the container comprises a single compartment bag in which a liquid absorbing agent is deposited to soak up the deposited fluid.

IN THE DRAWINGS

DESCRIPTION OF THE INVENTION

Figure 1:
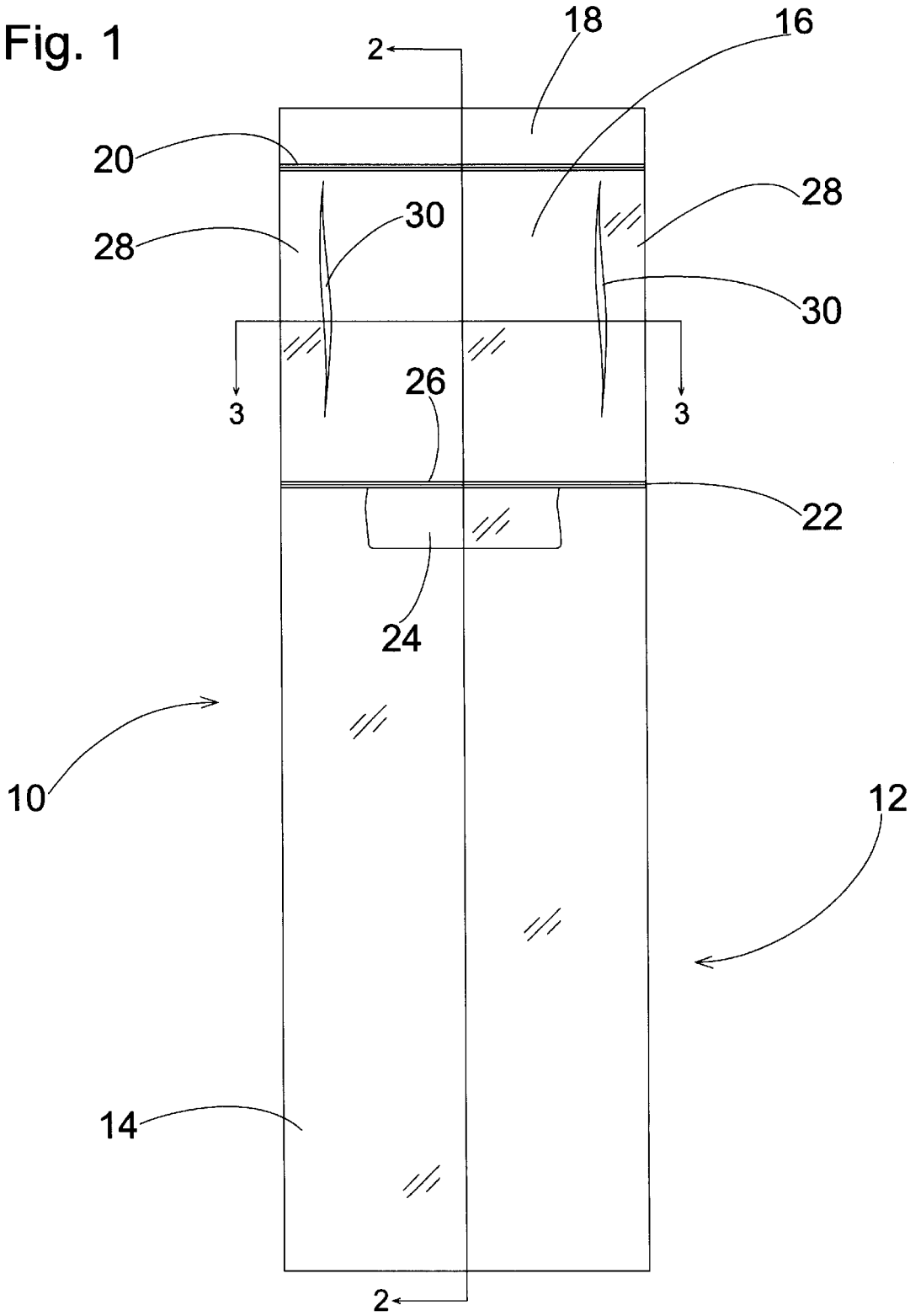
FIG. 1 is a view in side elevation of the fluid container.
Figure 4:
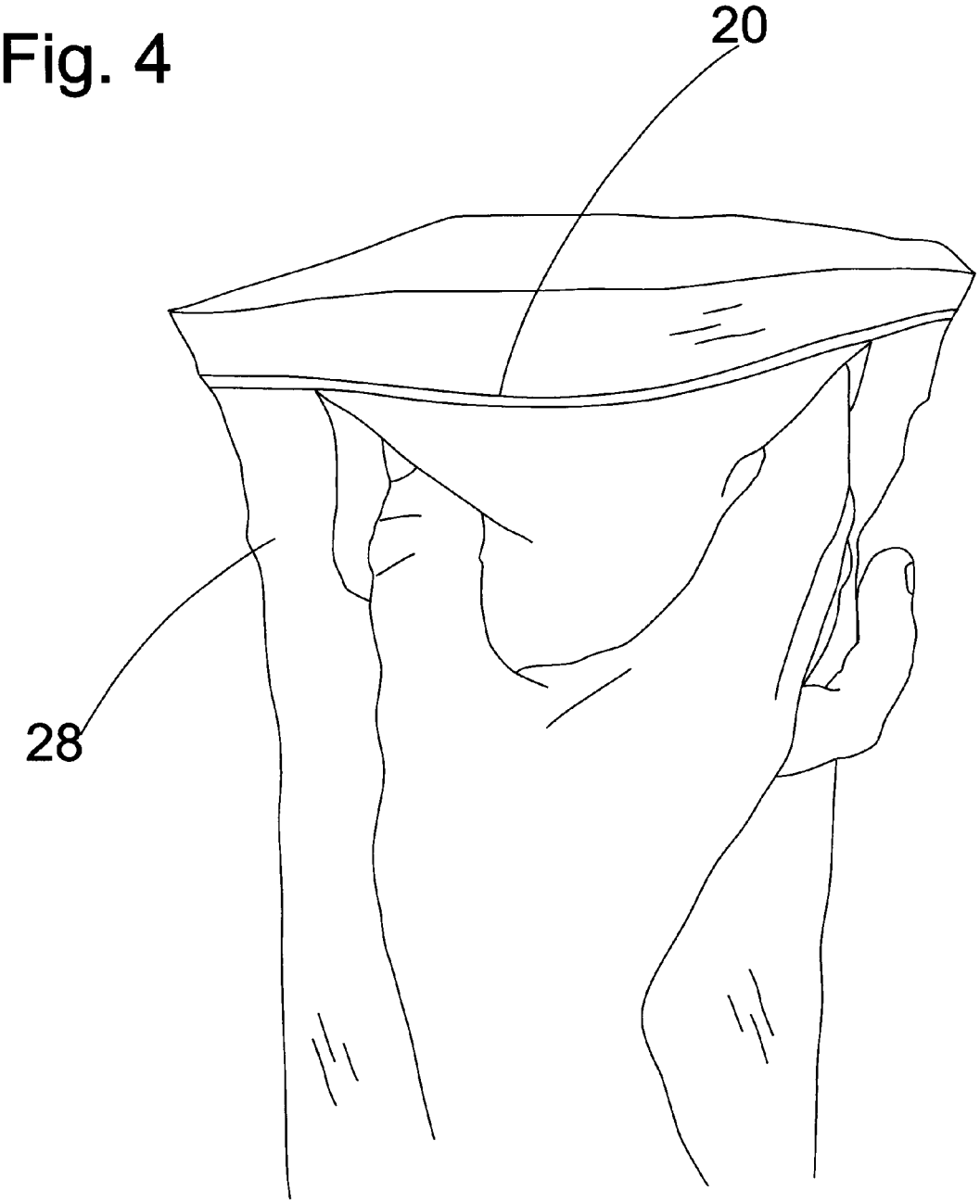
FIG. 4 is a perspective view of a person grasping the handles of the fluid container.

The fluid waste container of the instant invention is generally indicated by the reference numeral 10 as shown in FIG. 1. It is comprised of an elongated, flexible bag 12 made of plastic or other suitable material. Optimally, the bag is tubular shaped, but may be of a rectangular or other appropriate shape sufficient to contain a volume of liquid. The bag may be transparent or colored, or may even be ornamented with camouflage design. A containment chamber 14 is formed at a lower end of the bag. This chamber extends a substantial length of bag 12 as it will retain the deposited fluid. A passage chamber 16 is formed at the top end of the bag, and is in fluid communication with containment chamber 14. An opening 18 is disposed at the top of bag 12 above passage chamber 16. Bag 12 is provided with a sealing element 20 at opening 18 so that the bag may be opened and closed as use dictates. The sealing element may comprise a rib-and-groove interlocking arrangement, such as that marketed under the trademark ZIP-LOC®, that is disposed on inner surfaces of the bag near top opening 18. Alternately, a releasable adhesive may be used, or any form of sealing known to those skilled in the art, so long as the bag may be repeatedly opened and closed. Bag 12 is further provided with a second sealing element 22 at the opening 26 between containment chamber 14 and passage chamber 16. Sealing element 22 is similarly formed from a rib-and-groove interlocking arrangement, or other similarly described releasable seal as that comprising sealing element 20. Because sealing element 22 is not positioned near the bag opening, and therefore open ends of the bag are not available for grasping, a pair of tabs 24 may be provided on the outside of bag 12 adjacent to sealing element 22. These tabs may be grasped by the user to pull apart the bag to allow communication between passage chamber 16 and containment chamber 14 in preparation for use. Handle members 28 are formed into the side of bag 12 adjacent to passage chamber 16. Gaps 30 are disposed between the handle members and the bag so that a user may insert his fingers through the gaps as shown in FIG. 4 for a secure grip on the container bag. Passage chamber 16 has a smaller diameter than containment chamber 14, which helps act as a sheath for the penis and prevents splashing during urination.

Figure 5:
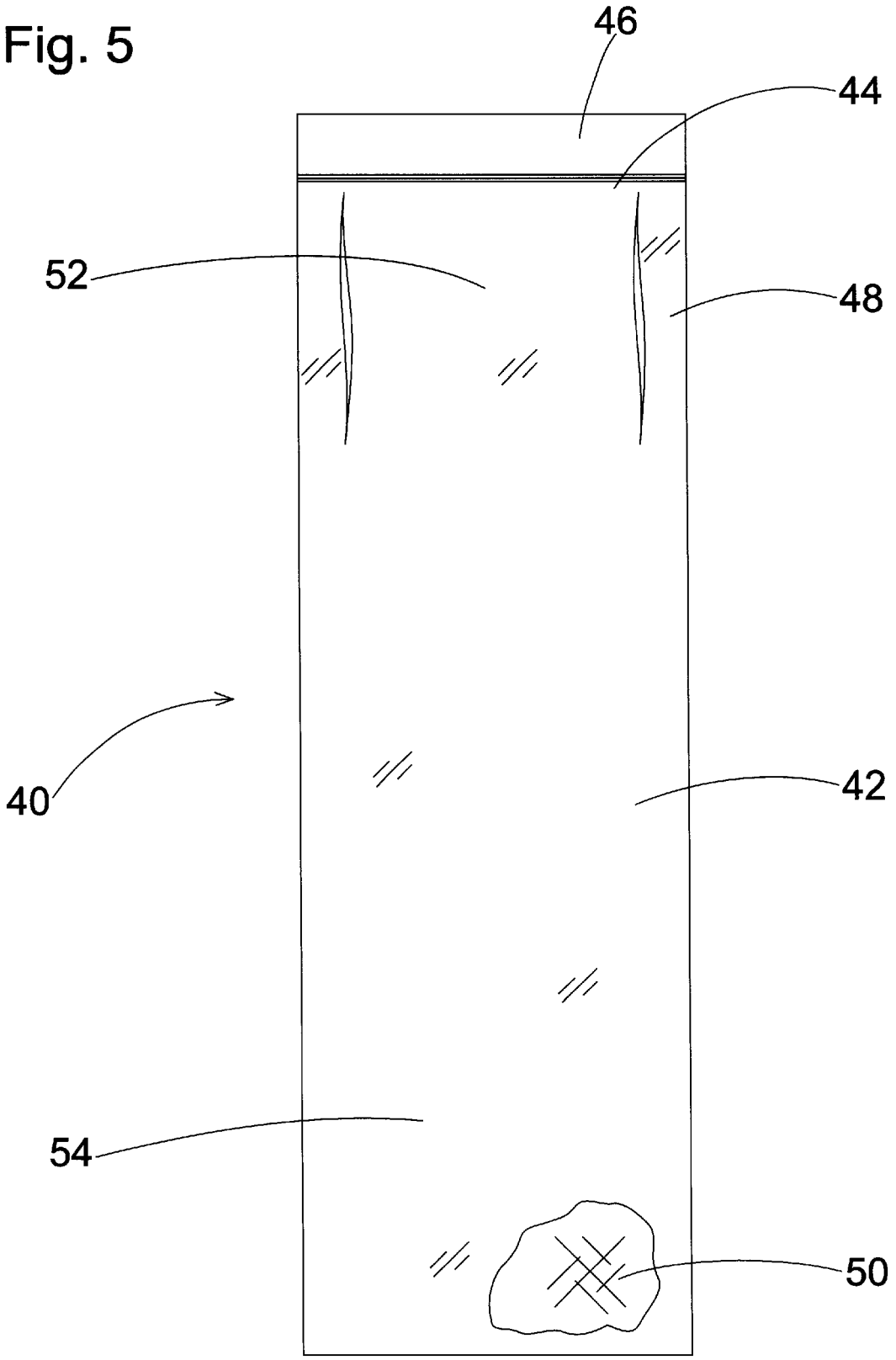
FIG. 5 is a view in side elevation, with a partial breakaway view, showing another embodiment of the fluid container.

Another embodiment of the fluid waste container is shown in FIG. 5 and is generally indicated by the reference numeral 40. It is comprised of a single containment chamber consisting of elongated bag 42. An upper portion 52 of bag 42 has a smaller diameter than lower portion 54, and helps form a sheath for the penis and prevents splashing during urination. A resealable sealing element 44 is placed at top opening 46. Handle members 48 are formed into bag 42 toward top opening 46. A liquid absorbing agent 50 may be provided in the bottom of bag 42 to reduce the chance of the retained liquid from splashing out of the waste container.

The fluid containment bag 12 may be easily manufactured from a single, elongated bag. Sealing elements 20 and 22 may be heat-pressed onto the interior sides of the bag at the appropriate locations using methods known to those skilled in the art. Elongated slits 30 can be cut into the bag to form handle members 28. The open edges of the bag walls formed by the cutting of the slits can be closed by heat sealing. Alternately, the containment bag 12 may be formed by aligning two sheets of plastic one on top of the other and heat sealing the perimeter edges to form an elongated bag. The sealing elements 20 and 22 can be positioned in place before the perimeter edge sealing is performed. Tabs 24 can be glued or heat sealed onto the bag at the area of sealing element 22.

Figure 2:
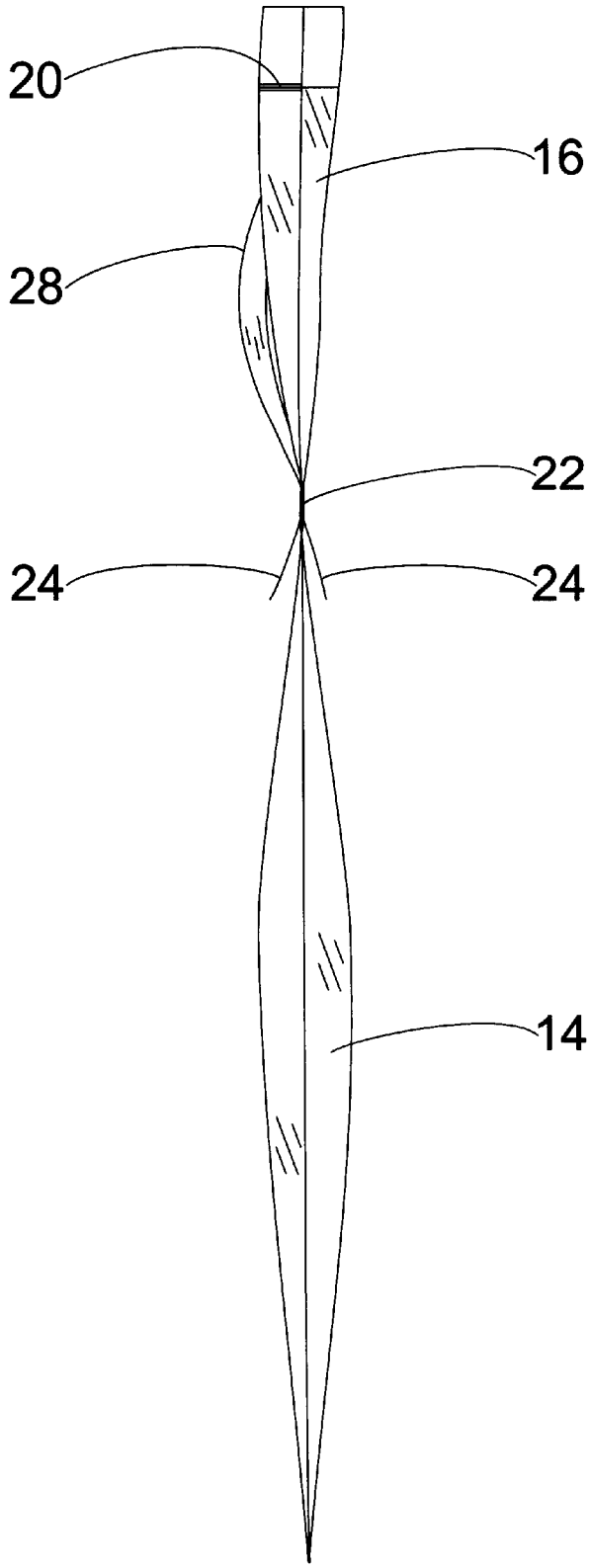
FIG. 2 is a cross-sectional view in side elevation taken along the lines 2—2 in FIG.
Figure 3:
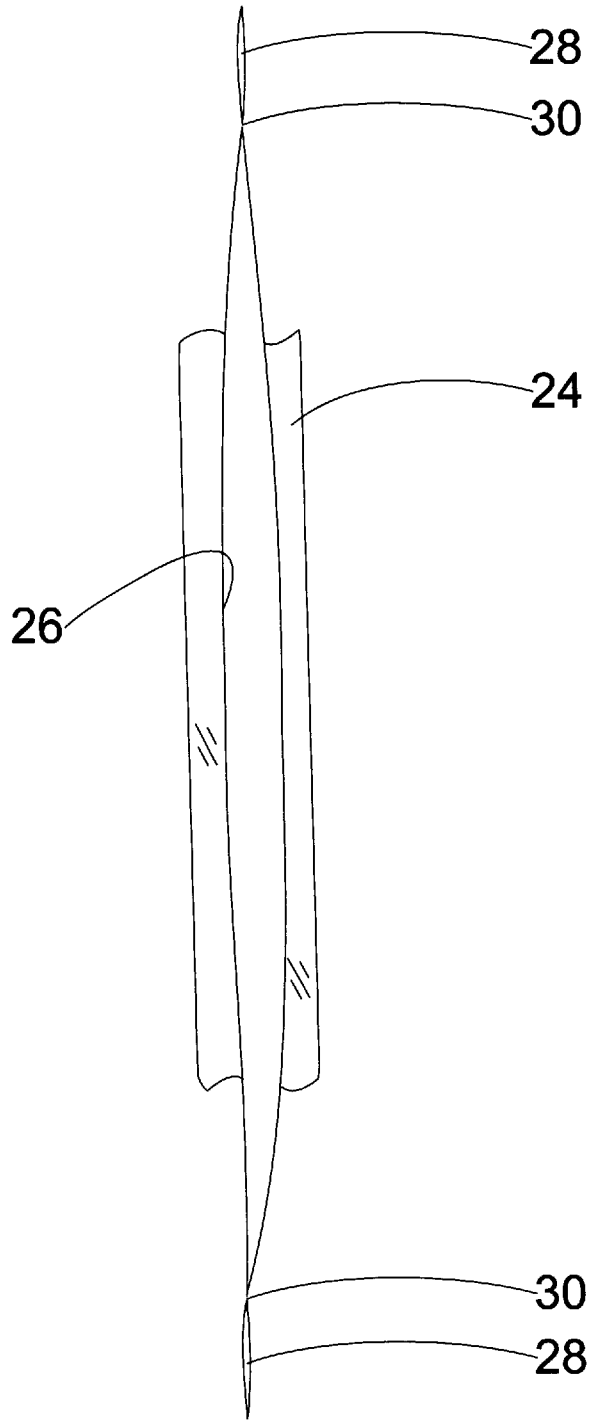
FIG. 3 is a cross-sectional view taken along lines 3—3 in FIG. 1.

Fluid container bag 12 is very simply employed to receive and retain urine waste. It is very effective in reducing the chance for spillage or leakage, and is capable of repeated use. Prior to use, a user will open up containment chamber 14, such action being facilitated by pulling tabs 24 so that the rib-and-groove elements of sealing element 22 may be separated as shown in FIGS. 2 and 3. It is not necessary that opening 26 be extended as wide as possible because liquid will naturally trickle down unimpeded into containment chamber 14 through even a narrow slit. Further, the pressure from the flowing fluid will force apart the walls of the bag. Passage chamber 16 is also opened by pulling apart sealing element 20. The user will hold the bag by inserting his fingers through gaps 30 as shown in FIG. 4. Handle members 28 provide support so that the bag does not slip from the grasp of the user. The handles can be manipulated to help keep the passage chamber open and also to vary the size of opening 18 at the top of the bag. Passage chamber 16 has a smaller diameter than containment chamber 14 and is dimensioned so as to receive the user's penis, acting somewhat as a sheath, to ensure that spillage does not occur during urination into the bag. The deposited fluid will pass from the point of entry in the passage chamber 16 and will flow into containment chamber 14. After use, the bag is re-sealed at 20 and 22, locking in the fluid in containment chamber 14. The dual sealing elements further ensure that no fluid is leaked from the bag. The bag may be re-used until containment chamber 14 is substantially full. Handle members 28 enable the filled bag to be easily carried, and also make it possible for hanging the bag from a supporting element such as a hook or branch. The alternate embodiment of fluid container bag 40 is provided as a single compartment, but is equipped with a liquid-absorbing agent 50 to reduce splashing during use and to reduce the fluid waste to a gel or solid to help eliminate leakage.

Various changes and modifications may be made within this invention as will be apparent to those skilled in the art. Such changes and modifications are within the scope and teaching of this invention as defined in the claims appended hereto.

What is claimed is:

1. A container for receiving and retaining human fluid waste, said container comprising an elongated flexible bag having a containment chamber and a passage chamber, said containment chamber having an opening at a top end thereof, said passage chamber having an upper opening and a lower opening, said passage chamber being disposed above and terminating at said top end of said containment chamber, said passage chamber being in fluid communication with said containment chamber, sealing elements being provided to completely close off said containment chamber and said passage chamber, respectively, said bag further having handle members disposed alongside said passage chamber.

2. The container of claim 1 in which said sealing elements are adapted to be releasably sealed, whereby said containment chamber and said passage chamber may each be repeatedly opened and closed.

3. The container of claim 2 in which a first sealing element is disposed at said first opening, said bag having a pair of external tab members placed adjacent to said first sealing element, whereby said tab members may be grasped to manipulate said first sealing element to effect opening of said containment chamber.

4. The container of claim 1 in which said handle members are each formed in and lie flush with a lateral edge of said bag, said handle members each forming a gap at said lateral edge of said bag to receive a user's fingers.

5. The container of claim 1 in which said passage chamber has a smaller diameter than said containment chamber.

6. The container of claim 1 in which said sealing elements are adapted to be releasably sealed, whereby said containment chamber and said passage chamber may each be repeatedly opened and closed, a first sealing element is disposed at said first opening, said bag having a pair of external tab members placed adjacent to said first sealing element, whereby said tab members may be grasped to manipulate said first sealing element to effect opening of said containment chamber, said handle members each being formed in and lying flush with a lateral edge of said bag, said handle members each forming a gap at said lateral edge of said bag to receive a user's fingers, said passage chamber having a smaller diameter than said containment chamber.

7. A container for receiving and retaining human fluid waste, said container comprising an elongated flexible bag comprising a containment chamber, said bag having an opening at an upper end thereof, said opening having a sealing element adapted to completely close off said bag along an edge of said opening at said upper end, said bag further having handle members disposed alongside said containment chamber to prevent leakage of fluid, said handle members being formed in and lying flush with a lateral edge of said bag, said handle members each forming a gap at said lateral edge of said bag to receive a user's fingers, said gap having a continuous, uninterrupted perimeter.

8. The container of claim 7 in which said sealing element is adapted to be releasably sealed, whereby said bag may be repeatedly opened and closed.

9. The container of claim 7 in which an upper portion of said containment chamber has a smaller diameter than that of a lower portion of said containment chamber.

10. The container of claim 7 in which said sealing element is adapted to be releasably sealed, whereby said bag may be repeatedly opened and closed, an upper portion of said containment chamber having a smaller diameter than that of a lower portion of said containment chamber.

* * * * *